US006896501B2

(12) United States Patent
Ueno et al.

(10) Patent No.: US 6,896,501 B2
(45) Date of Patent: May 24, 2005

(54) SINGLE-SCREW COMPRESSOR

(75) Inventors: Hiromichi Ueno, Sakai (JP); Kaname Ohtsuka, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/250,374

(22) PCT Filed: Dec. 7, 2001

(86) PCT No.: PCT/JP01/10719

§ 371 (c)(1),
(2), (4) Date: Jul. 1, 2003

(87) PCT Pub. No.: WO02/055882

PCT Pub. Date: Jul. 18, 2002

(65) Prior Publication Data

US 2004/0037730 A1 Feb. 26, 2004

(30) Foreign Application Priority Data

Jan. 5, 2001 (JP) ..... 2001-000620

(51) Int. Cl.[7] ..... F03C 2/00
(52) U.S. Cl. ..... 418/195; 74/458; 74/462
(58) Field of Search ..... 418/195; 74/458, 74/462, 415

(56) References Cited

U.S. PATENT DOCUMENTS 2,279,414 A * 4/1942 Scott ..... 74/458
2,402,805 A * 6/1946 Cousino ..... 418/195
2,603,412 A * 7/1952 Roland ..... 418/195
3,632,239 A 1/1972 Zimmern
4,028,016 A 6/1977 Keijer
4,227,867 A 10/1980 Whitehill et al.
4,342,548 A * 8/1982 Zimmern ..... 418/195
6,148,683 A * 11/2000 Fleytman ..... 74/425

FOREIGN PATENT DOCUMENTS

JP 6-42475 A 2/1994

* cited by examiner

*Primary Examiner*—Theresa Trieu
(74) *Attorney, Agent, or Firm*—Birch Stewart Kolasch & Birch, LLP

(57) ABSTRACT

Present invention provides a single screw compressor from which only a small amount of gas to be compressed leaks and which can be manufactured at low costs. There are provided a screw rotor 1 having six grooves 2, 2, . . . and a gate rotor 4 having 12 teeth 5, 5, . . . which are installed in a casing. Since six, which is the number of the grooves of the screw rotor 2, and twelve, which is the number of the teeth 5 of the gate rotor, have a common divisor, only predetermined teeth 6 are engaged with a groove 2. Therefore, engagement combinations of the grooves 2 and the teeth 5 are divided into six groups. In each of these groups, dimension accuracy is controlled so that the grooves 2 and the teeth 5 engaged each other have appropriate clearances. Since manufacture is easier when dimension accuracy is controlled within each group than when dimension accuracy of all grooves 2 and teeth 5 is controlled at one time as in a conventional case, this single screw compressor becomes inexpensive.

7 Claims, 5 Drawing Sheets

SINGLE-SCREW COMPRESSOR

This application is the national phase under 35 U.S.C. §371 of PCT International Application No. PCT/JP01/10719 which has an International filing date of Dec. 7, 2001, which designated the United States of America.

TECHNICAL FIELD

The present invention relates to a single screw compressor.

BACKGROUND ART

Conventional single screw compressors of this kind include the one shown in FIG. 7A. This single screw compressor has a screw rotor 102 which is installed in a casing (not shown) and has spiral grooves 101, 101 . . . , a shaft 104 driving the rotation of this screw rotor 102 around its axis and two gate rotors 107, 107 which have teeth 106, 106 . . . engaged with the grooves 101, 101 . . . of the screw rotor 102 and rotate around their axes substantially perpendicular to the axis of the screw rotor 102. FIG. 7B is a cross sectional view showing the single screw compressor in a plane including the axis of the screw rotor 102, and shows the screw rotor 102 and one gate rotor 107 of the two gate rotors 107 engaged with the screw rotor 102. When rotation of the screw rotor 102 is driven by the shaft 104 as shown with arrow A in FIG. 7A, the gate rotors 107, 107 rotate in a direction shown with arrow B. Consequently, the volume of compression spaces partitioned by an inner surface of the casing (not shown), the grooves 101 of the screw rotor and the teeth 106 of the gate rotors are reduced and hence gases introduced into the compression spaces are compressed.

The number of the grooves 101 of the screw rotor 102 is six, and the number of the teeth 106 of the gate rotor 107 is eleven. Since six, which is the number of the grooves 101, and eleven, which is the number of the teeth 106, are relatively prime, all the teeth 106, 106 . . . are each engaged with all the grooves 101, 101 . . . when this single screw compressor is operated.

However, since all the teeth 106, 106 . . . of the gate rotor 107 are each engaged with all the grooves 101, 101 . . . of the screw rotor 102, the conventional single screw compressor needs to be formed so that any of the teeth 106 of the gate rotor 107 can be engaged with a groove 101 having the smallest dimension in the screw rotor 102. That is, the largest tooth 106 dimension in the gate rotor 107 needs to be made smaller than the smallest groove 101 dimension in the screw rotor 102. Consequently, when a tooth 106 of the gate rotor 107 having the smallest dimension is engaged with a groove 101 of the screw rotor 102 having the largest dimension, a clearance between the groove 101 and the tooth 106 becomes large, and a problem arises that a gas to be compressed leaks. In order to prevent this gas leakage, the gate rotors 107 and the screw rotor 102 need to be processed in high accuracy with an extremely small dimensional tolerance so that the clearance between the teeth 106 and the grooves 101 becomes small. As a result, costs for processing the gate rotors 107 and the screw rotor 102 become high, and hence costs for manufacturing the single screw compressor become high.

DISCLOSURE OF THE INVENTION

Accordingly, an object of the present invention is to provide a single screw compressor from which only a small amount of gas to be compressed leaks and which can be manufactured at low costs.

In order to accomplish the above object, the present invention provides a single screw compressor comprising:

a casing;

a screw rotor installed in the casing; and a gate rotor having teeth to be engaged with grooves of the screw rotor, said gate rotor being adapted to rotate around an axis substantially perpendicular to an axis of the screw rotor, wherein the number of grooves of the screw rotor and the number of teeth of the gate rotor have a common divisor.

According to the present invention, since the number of the grooves of the screw rotor and the number of the teeth of the gate rotor have a common divisor, each groove of the screw rotor is engaged with specific teeth out of the teeth of the gate rotor. That is, combinations of the grooves of the screw rotor and the teeth of the gate rotor that are engaged with each other are divided into a plurality of groups. Dimension accuracy of the teeth and the grooves is determined so that the largest tooth dimension in the gate rotor is smaller than the smallest groove dimension in the screw rotor within each of these groups. Furthermore, this dimension accuracy of the teeth and the grooves is determined so that the clearance between the teeth and the grooves becomes small enough to prevent leakage of a gas to be compressed from this single screw compressor. Since this dimension accuracy of the teeth and the grooves is controlled within each of the plurality of groups, as a result, appropriate engagements can be formed for all the grooves and all the teeth and leakage of the gas can be prevented. In this case, it is easier to control the dimension accuracy of the grooves and the teeth within each group than to control the dimension accuracy of all the grooves and the teeth at one time as in the conventional case. Therefore, the screw rotor and the gate rotor of the single screw compressor of the present invention can be processed more easily than those of the conventional one. As a result, costs for processing the screw rotor and the gate rotor become lower, and the costs for manufacturing the single screw compressor become low.

In an embodiment, the teeth of the gate rotor are sector-shaped.

According to this embodiment, the sector-shaped tooth has an area larger than that of a substantially rectangular tooth of the conventional gate rotor. In this case, although a groove of the screw rotor to be engaged with the sector-shaped tooth has substantially the same width on the peripheral surface of the screw rotor as that of a groove engaged with the conventional rectangular tooth, the cross sectional area of the groove is larger. That is, although the dimension of the screw rotor is substantially the same, the volume of the compression space is larger. Therefore, according to the present invention, the compression volume is increased without enlarging the single screw compressor. Here, the sector-shaped teeth and the grooves to be engaged with the teeth are harder to process than the conventional substantially rectangular teeth and the grooves, and it is very difficult to process these in dimension accuracy equivalent to those of the rectangular teeth and the grooves. However, since the number of the sector-shaped teeth and the number of the grooves to be engaged with these teeth have a common divisor, dimension accuracy of the teeth and the grooves is controlled within each of a plurality of groups. That is, the teeth and the grooves are formed more easily than when dimension accuracy is controlled for all the teeth and the grooves. Therefore, the single screw compressor of the present invention has a larger compression volume without enlarging the single screw compressor, and is relatively easily manufactured.

In an embodiment, an angle which a side edge of the tooth forms with a line which passes through the center of the tooth of the gate rotor in its radial direction is 10° or smaller.

According to this embodiment, since a side edge of the tooth of the gate rotor forms an angle of 10° or smaller with a line in the radial direction, the compression volume of the single screw compressor is effectively increased. Here, when the angle which the side edge of the tooth of the gate rotor forms with the line in the radial direction is larger than 10°, the groove engaged with this tooth cannot be formed in the screw rotor without changing dimension of the screw rotor. Therefore, by making the angle which the sideline of the tooth of the gate rotor forms with the line in the radial direction 10° or smaller, single screw compressor having a small size and high efficiency can be obtained.

In an embodiment, at least one end corner of at least one of the teeth of the gate rotor is made round.

According to this embodiment, when the single screw compressor is assembled, since the round corner of the tooth does not interfere with a ridge between the grooves of the screw rotor, the teeth of the gate rotor are smoothly engaged with the grooves of the screw rotor, and hence the single screw compressor can be readily assembled.

In an embodiment, the number of the grooves of the screw rotor and the number of teeth of the gate rotor are six and ten, or six and twelve, respectively.

According to this embodiment, efficiency of the single screw compressor is improved.

BEST MODE FOR CARRYING OUT THE INVENTION

Embodiments of the present invention are described below in detail with reference to the accompanying drawings.

Figure 1A:
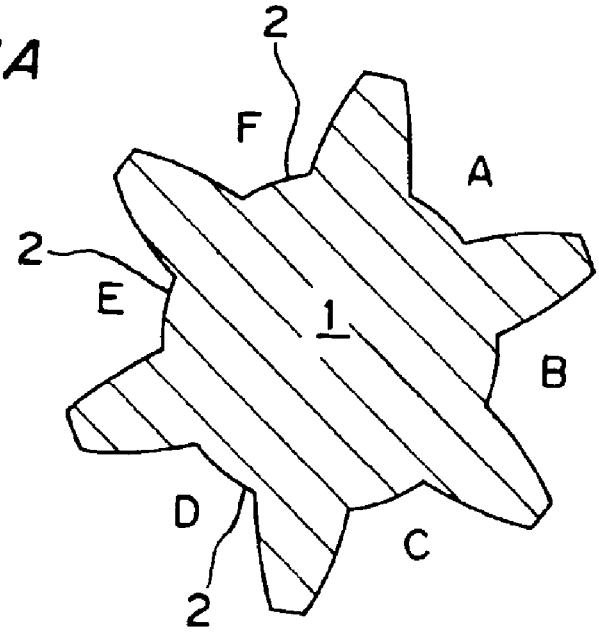
FIG. 1A is a cross sectional view showing a screw rotor included in a single screw compressor according to a first embodiment of the invention.
Figure 1B:
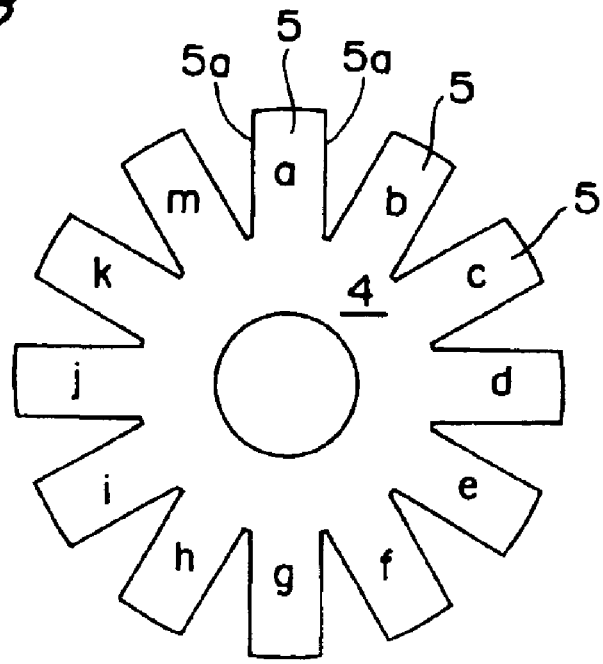
FIG. 1B is a plan view showing a gate rotor included in this single screw compressor.
Figure 7A:
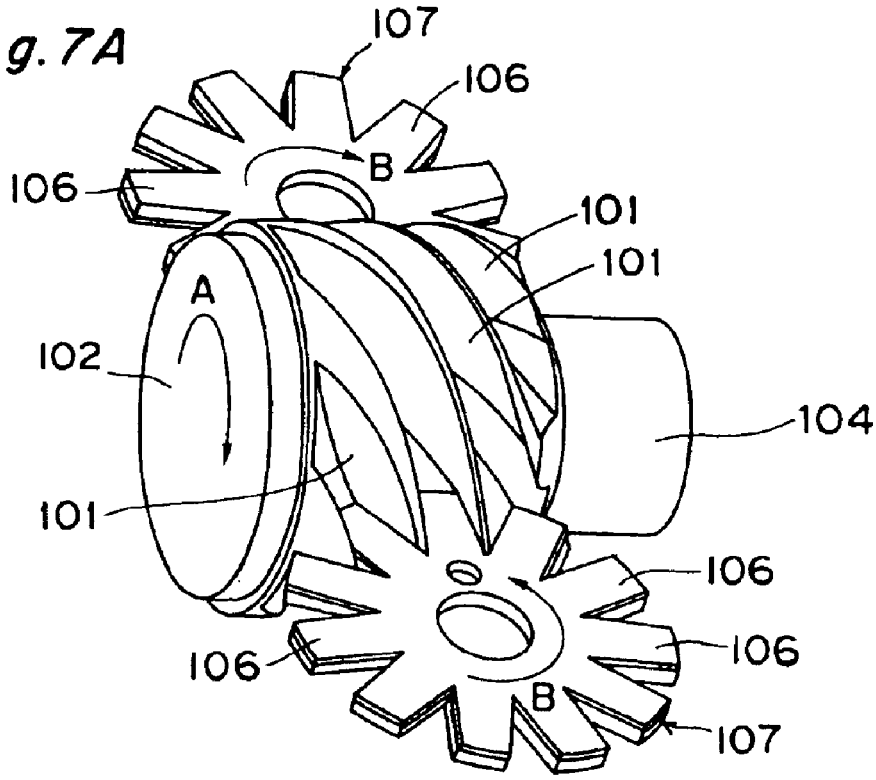
FIGS. 7A and 7B show a conventional single screw compressor.
Figure 7B:
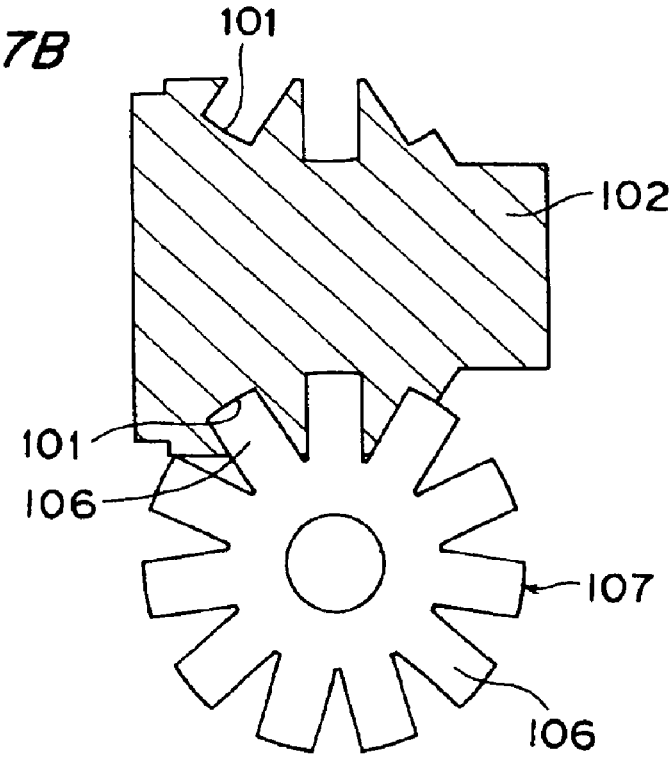

FIG. 1A is a cross sectional view showing a screw rotor included in a single screw compressor according to a first embodiment of the invention, which is a cross sectional view in a direction substantially perpendicular to a rotation axis of the screw rotor. This screw rotor 1 has six spiral grooves 2, 2, . . . and is installed in a casing (not shown). FIG. 1B is a plan view showing a gate rotor included in this single screw compressor. This gate rotor 4 has 12 teeth 5, 5, . . . , and a side face 5*a* of the tooth 5 is formed substantially in parallel to the radial direction of the gate rotor 4. The axis of the gate rotor 4 is disposed substantially perpendicular to the axis of the screw rotor 1, and the teeth 5, 5, . . . of the gate rotor are engaged with the grooves 2, 2, . . . of the screw rotor. Two said gate rotors 4, 4 are engaged with the screw rotor 1 in substantially the same way as shown in FIG. 7A.

In the single screw compressor according to the present invention, since six, which is the number of the grooves 2 of the screw rotor 1, and twelve, which is the number of the teeth 5 of the gate rotor 4, have a common divisor, only predetermined teeth 5 are engaged with each groove 2. In order to specifically explain this, six symbols of "A", "B", "C", "D", "E" and "F" are assigned to six grooves 2, 2, . . . of the screw rotor 1 as shown in FIG. 1A. Meanwhile, twelve symbols of "a", "b", "c", "d", "e", "f", "g","h","i", "j", "k" and "m" are assigned to twelve teeth 5, 5, . . . of the gate rotor 4 as shown in FIG. 1B. When a tooth 5 with symbol "a" is engaged with a groove 2 with symbol "A" to operate the single screw compressor, tooth 5 with symbols "g" is also engaged with the groove 2 with symbol "A". Furthermore, only teeth 5, 5 with symbols "b" and "h" are engaged with a groove 2 with symbol "B", only teeth 5, 5 with symbols "c" and "i" are engaged with a groove 2 with symbol "C", only teeth 5, 5 with symbols "d" and "j" are engaged with a groove 2 with symbol "D", only teeth 5, 5 with symbols "e" and "k" are engaged with a groove 2 with symbol "E", and only teeth 5, 5 with symbols "f" and "m" are engaged with a groove 2 with symbol "F". That is, two teeth 5, 5 which are located at positions point-symmetrical with respect to the center of the gate rotor 4, are engaged with a same groove 2 of the screw rotor 1. Thus, this single screw compressor has six groups of combinations of the grooves of the screw rotor 2 and the teeth 5 of the gate rotor 1. In each of these groups, dimension accuracy is controlled so that the groove 2 and the teeth 5, 5 engaged with each other, for example, the groove 2 with symbol "A" and teeth 5, 5 with symbols "a" and "b" have an appropriate clearance.

When the single screw compressor is operated, the volume of compression spaces formed by an inner surface of a casing (not shown), the grooves of the screw rotor 2 and the teeth of the gate rotor 5 engaged with these grooves 2 are reduced, and gases introduced into the compression spaces are compressed.

Since dimension accuracy of the grooves of the screw rotor 2, 2, . . . and the teeth 5, 5, . . . of the gate rotor is controlled within each of the six groups, the grooves 2, 2, . . . and the teeth 5, 5, . . . are engaged while forming appropriate clearances in each of the groups. Therefore, only a small amount of a compressed gas leaks from this single screw compressor. Furthermore, since dimension accuracy of the grooves 2, 2, . . . and the teeth 5, 5, . . . is controlled within each of the six groups, this single screw compressor can be manufactured more easily than dimension accuracy of all the grooves and the teeth being controlled as in the conventional case.

Therefore, this single screw compressor suffers little gas leakage and is inexpensive.

Figure 2:
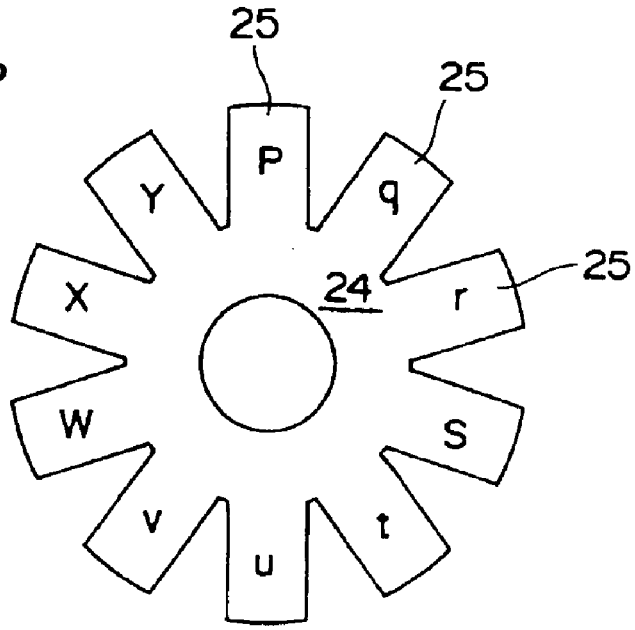
FIG. 2 shows a gate rotor included in a single screw compressor according to a second embodiment.

FIG. 2 shows a gate rotor included in a single screw compressor according to a second embodiment. This gate rotor 24 has ten teeth 25, 25, . . . . Furthermore, this single screw compressor has a screw rotor 1 having substantially the same shape as that of the screw rotor 1 in FIG. 1A, and this screw rotor 1 has six grooves 2, 2 . . . . When the screw rotor 1 and the gate rotor 24 are engaged to perform compression, there are two groups of engagement combinations of six grooves 2, 2 . . . of the screw rotor and ten teeth 25, 25, . . . of the gate rotor. That is, as shown in FIG. 2, symbols of "p", "q", "r", "s", "t", "u", "v", "w", "x" and "y" are assigned to the teeth 25, 25, . . . of the gate rotor, and engagement of the screw rotor 1 and the gate rotor 24 where the tooth 25 with symbol "p" is engaged with the groove 2 with symbol "A" in FIG. 1A is assumed. When this single screw compressor is operated, five teeth 25, 25, . . . with symbols "p", "v", "r", "x" and "t" are engaged with the three grooves 2, 2, 2 with symbols "A", "C", "E". Furthermore, five teeth 25, 25, . . . with symbols "q", "w", "s", "y" and "u" are engaged with three grooves 2, 2, 2 with symbols "B", "D" and "F".

In two groups of engagement combinations of the grooves 2 and the teeth 25, the dimension accuracy of the grooves 2 and the teeth 25 is controlled within each group. That is, in each of the groups, the grooves 2 and the teeth 25 are formed so that they form appropriate clearances below a predetermined value when engaged. Therefore, the gas leakage when this single screw compressor operates can be effectively reduced. Furthermore, since the dimension accuracy of the grooves 2 and the teeth 25 needs to be controlled only within a group, the single screw compressor can be manufactured at lower costs than when dimension accuracy of all grooves and teeth is controlled as in the conventional case.

Figure 3:
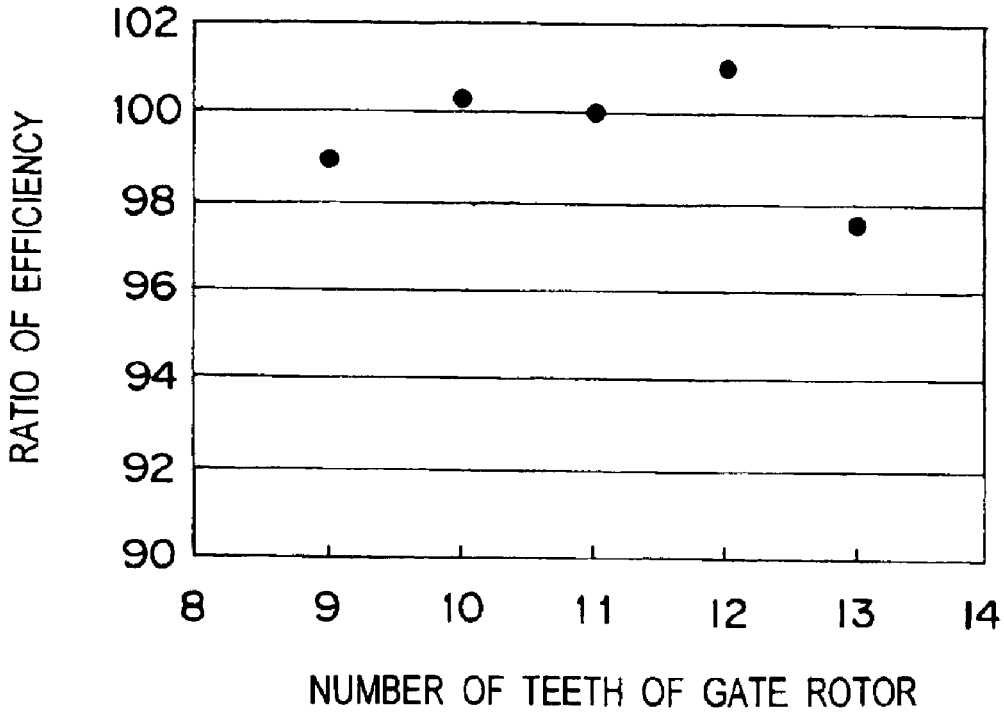
FIG. 3 shows efficiency of the single screw compressors equipped with a screw rotor having six grooves depending on the number of teeth when gate rotors each having a different number of teeth are used.

FIG. 3 shows efficiency rate of the single screw compressor equipped with a screw rotor having six grooves depending on the number of the teeth when the numbers of teeth of the gate rotor are varied from nine to thirteen. In FIG. 3, the horizontal axis represents the number of teeth of the gate rotor, and the vertical axis represents the efficiency rate of the single screw compressor equipped with the gate rotor having each number of teeth. This efficiency rate is obtained by assuming the efficiency of a conventional single screw compressor equipped with a gate rotor having eleven teeth as 100. As shown in FIG. 3, when the number of teeth of the gate rotor is made ten or twelve, the efficiency rate of the compressor becomes 100 or higher. Thus, a single screw compressor having higher efficiency than the conventional one can be obtained.

Figure 4A:
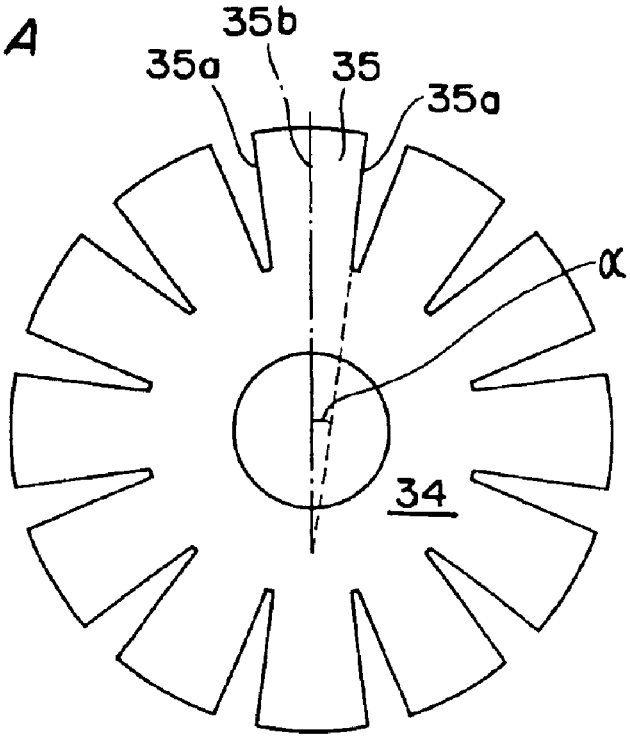
FIG. 4A shows a gate rotor included in a single screw compressor according to a third embodiment.
Figure 4B:
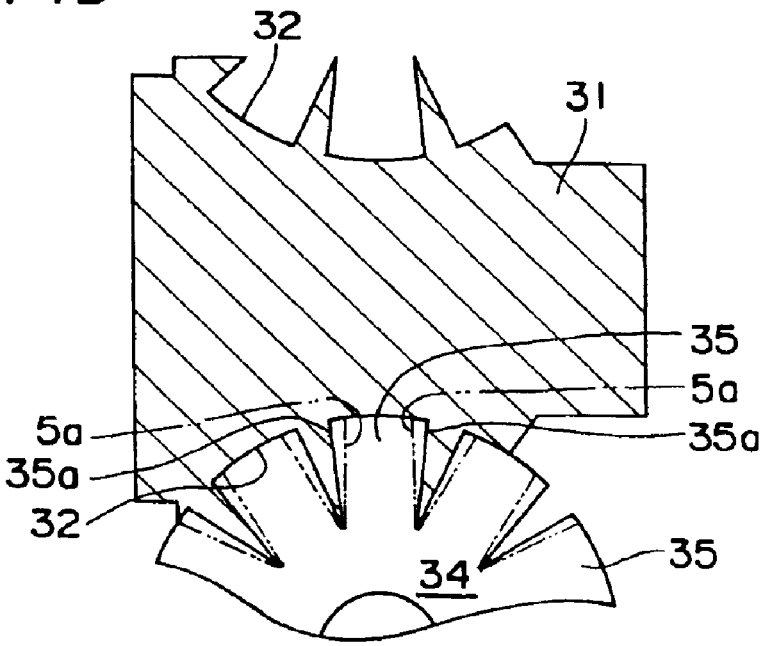
FIG. 4B is a cross sectional view showing how the gate rotor is engaged with the screw rotor.

FIG. 4A shows a gate rotor included in a single screw compressor according to a third embodiment. This gate rotor 34 has twelve teeth 35, 35, . . . , and a side edge 35*a*, 35*a* of the tooth 35 forms an angle $\alpha$ of substantially 10° with a center line 35*b* of the tooth 35 and thereby is sector-shaped. Furthermore, this single screw compressor is equipped with a screw rotor 31 having substantially the same dimension as the dimension of the screw rotor 1 in FIG. 1A. FIG. 4B is a cross sectional view showing how the gate rotor 34 is engaged with this screw rotor 31. FIG. 4B shows that only one gate rotor 34 is engaged with the screw rotor 31. FIG. 4B shows by using overlapped imaginary lines how the screw rotor 1 and the gate rotor 4 of the first embodiment are engaged.

As shown in FIG. 4B, in the gate rotor 34, the tooth 35, which has a side edge 35*a* forming an angle $\alpha$ of substantially 10° with the center line 35*b* of tooth 35 and is sector-shaped, has an area larger than the substantially rectangular tooth 5 of the first embodiment whose side edges 5*a*, 5*a* are formed substantially in parallel. Along with this, a groove 32 of the screw rotor 31 of this embodiment has a cross sectional area larger than that of the groove 2 of the screw rotor 1 of the first embodiment. That is, in the single screw compressor of this embodiment, the volume of compression spaces formed by the inner surface of the casing (not shown), the grooves 32 and the teeth 35 are larger than those of the single screw compressor of the first embodiment. Here, the outer shape dimensions of the screw rotor 31 and the gate rotor 34 are substantially the same as the outer shape dimensions of the screw rotor 1 and the gate rotor 4 of the first embodiment. Therefore, according to this embodiment, the compression volume can be increased without enlarging the single screw compressor. Here, it was confirmed by experiments that the compression volume of the single screw compressor of this embodiment could be made 127% larger than that of the single screw compressor of the first embodiment.

It is noted that, when the angle which the side edge 35*a*, 35*a* of the tooth 35 of the gate rotor forms with the center line 35*b* of the tooth 35 is larger than 10°, grooves to be engaged with the teeth 35 cannot be formed without changing the dimensions of the screw rotor. Therefore, by making the angle between the sideline 35*a*, 35*a* of the tooth 35 of the gate rotor and the center line 35*b* 10° or smaller, a single screw compressor having a small size and favorable efficiency can be obtained.

Furthermore, since the number of teeth 35, 35, . . . of the gate rotor 34 is twelve, and the number of grooves 32 of the screw rotor 31 is six, the number of the teeth 35 and the number of grooves 32 have a common divisor. Therefore, there are six groups of engagement combinations of the teeth 35 and the groove 32. For each of these six groups, the dimension accuracy of the teeth 35 and the grooves 32 is controlled so that clearances between the teeth 35 and the grooves 32 become smaller than a predetermined value. Therefore, this single screw compressor can be manufactured more easily at lower costs than when the dimension accuracy of all grooves and teeth is controlled as in the conventional case.

Figure 5:
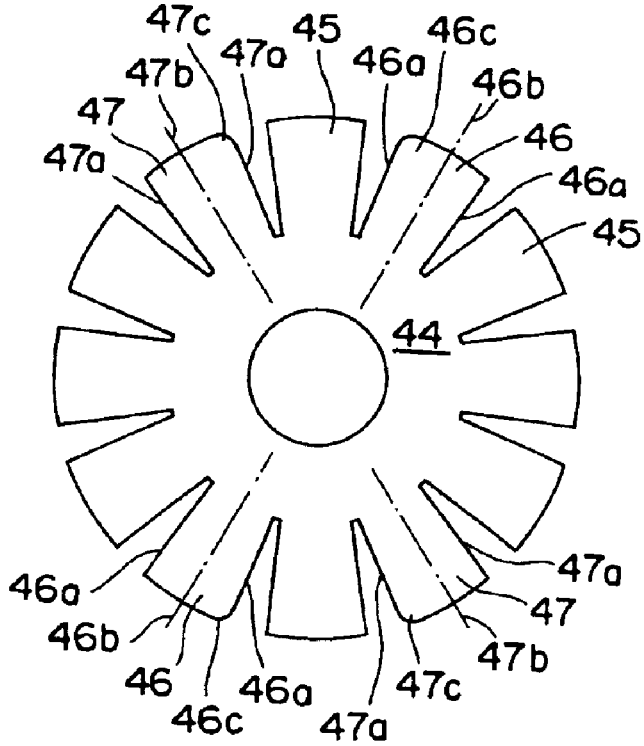
FIG. 5 shows a gate rotor included in a single screw compressor according to a fourth embodiment of the invention.

FIG. 5 shows a gate rotor of a single screw compressor according to a fourth embodiment of the invention. This gate rotor 44 has twelve teeth 45, 46, 47, . . . , and one end corners of four teeth 46, 46, 47, 47 out of these twelve teeth 45, 46, 47 . . . are round. More specifically, in the case of the tooth 46*a*, a corner 46*c* on the left side to the center line 46*b* of the tooth 46 is round when viewed from the center of the gate rotor 44. Meanwhile, in the case of the tooth 47, a corner 47*c* on the right side to the center line 47*b* of the tooth 47 is round when viewed from the center of the gate rotor 44. All the three kinds of teeth 45, 46, 47 having different shapes included in the gate rotor 44 are substantially sector-shaped while the side edges 45*a*, 46*a*, 47*a* form an angle of substantially 10° with the center lines 45*b*, 46*b*, 47*b* of the teeth 45, 46, 47.

When the single screw compressor is assembled, since the gate rotor 44 has teeth 46, 47 with round corners 46*c*, 47*c*, the round corners 46*c*, 47*c* do not interfere with ridges between the grooves of the screw rotor. Therefore, the teeth 45, 46, 47 of the gate rotor 44 can be smoothly engaged with the grooves of the screw rotor, and, as a result, the single screw compressor can be readily assembled.

Furthermore, this single screw compressor includes a screw rotor (not shown) having grooves in shapes corresponding to the shapes of the teeth 45, 46, 47, . . . of the gate rotor 44. Since the number of the grooves of this screw rotor is six, and the number of the teeth of the gate rotor 44 is twelve, these have a common divisor. The number of the grooves of the screw rotor and the number of the teeth 45, 46, 47 of the gate rotor 44 are the same as the number of the grooves 2 of the screw rotor 1 and the number of the teeth 5 of the gate rotor 4, respectively, in the single screw compressor of the first embodiment. Therefore, in the single screw compressor of this embodiment, engagement combinations of the grooves of the screw rotor and the teeth 45, 46, 47 of the gate rotor 44 are also divided into six groups. Here, two teeth, which are located at positions point-symmetrical with respect to the center of the gate rotor 44, are engaged with one groove of the screw rotor. Therefore, the teeth 46, 46 and the teeth 47, 47 whose corners at the same positions when viewed from the center of the gate rotor 44 are made round and which are arranged at point-symmetrical positions are engaged with the same grooves, respectively. That is, only two grooves out of the six grooves of the screw rotor need to be formed in cross-sectional shapes corresponding to the shapes of the teeth 46, 47. When corners of the teeth are made round in a conventional single screw compressor wherein the number of grooves of the screw rotor and the number of teeth of the gate rotor are relatively prime, all grooves need to be formed in shapes corresponding to the round shapes since the teeth are engaged with all grooves. Therefore, much labor and costs are required. On the contrary, according to the present invention, labor for making the corners 46*c*, 47*c* of the teeth 46, 47 of the gate rotor 44 round and labor for forming the grooves engaged with these teeth 46, 47 in shapes corresponding to these round shapes can be minimized. Therefore, labor and costs for manufacturing the single screw compressor can be reduced. In addition, dimension accuracy of the grooves of the screw rotor and the teeth 45, 46, 47 of the gate rotor 44 in the six groups needs to be controlled only within each group. Therefore, the single screw compressor of this embodiment has a small size and favorable efficiency, is easy to assemble and can be manufactured at low costs.

Each of the teeth 46, 47 of the gate rotor 44 is provided with one round corner 46*c*, 47*c* in the fourth embodiment, but one tooth may be provided with two round corners.

Figure 6:
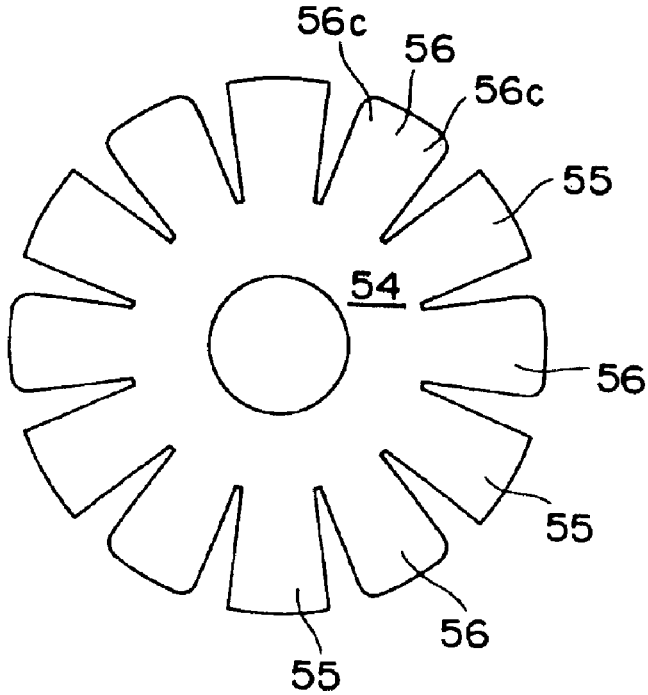
FIG. 6 shows a gate rotor having teeth with two round corners and teeth with two square corners alternately disposed around the rotation axis.

Furthermore, in the fourth embodiment, the gate rotor 44 has four teeth 46, 47 with round corners 46*c*, 47*c*, but the gate rotor may have any number of teeth with round corners. For example, as shown in FIG. 6, two corners 56*c*, 56*c* of one tooth 56 of the gate rotor 54 may be made round and these teeth 56 having round two corners 56*c*, 56*c* and teeth 55 having square two corners may be disposed alternately around the shaft. Furthermore, all the teeth of the gate rotor may have a round corner.

What is claimed is:

1. A single screw compressor comprising:

a screw rotor; and a gate rotor having teeth to be engaged with grooves of the screw rotor, said gate rotor being adapted to rotate around an axis substantially perpendicular to an axis of the screw rotor, wherein the number of grooves of the screw rotor and the number of teeth of the gate rotor have a common divisor, and an angle which a side edge of each tooth forms with a line which passes through a center of the tooth of the gate rotor in its radial direction is substantially 10°.

2. The single screw compressor according to claim 1, wherein the teeth of the gate rotor are sector-shaped.

3. The single screw compressor according to claim 2, wherein at least one end corner of at least one of the teeth of the gate rotor is made round.

4. The single screw compressor according to claim 2, wherein the number of the grooves of the screw rotor and the number of teeth of the gate rotor are 6 and 10, or 6 and 12, respectively.

5. The single screw compressor according to claim 1, wherein at least one end corner of at least one of the teeth of the gate rotor is made round.

6. The single screw compressor according to claim 5, wherein the number of the grooves of the screw rotor and the number of teeth of the gate rotor are 6 and 10, or 6 and 12, respectively.

7. The single screw compressor according to claim 1, wherein the number of the grooves of the screw rotor and the number of teeth of the gate rotor are 6 and 10, or 6 and 12, respectively.

* * * * *